US010726717B2

(12) United States Patent
Puckett et al.

(10) Patent No.: US 10,726,717 B2
(45) Date of Patent: Jul. 28, 2020

(54) ANONYMOUS WIRELESS ADDRESS MATCHING FOR TRAFFIC INFORMATION

(71) Applicant: The Texas A&M University System, College Station, TX (US)

(72) Inventors: Darryl D. Puckett, Houston, TX (US); Michael J. Vickich, Houston, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 15/866,178

(22) Filed: Jan. 9, 2018

(65) Prior Publication Data

US 2018/0130345 A1 May 10, 2018

Related U.S. Application Data

(63) Continuation of application No. 12/790,903, filed on May 31, 2010, now abandoned.

(60) Provisional application No. 61/182,341, filed on May 29, 2009.

(51) Int. Cl.
*G08G 1/01* (2006.01)

(52) U.S. Cl.
CPC ..... *G08G 1/0104* (2013.01)

(58) Field of Classification Search
CPC combination set(s) only.
See application file for complete search history.

(56) References Cited

U.S. PATENT DOCUMENTS

2002/0107634 A1* 8/2002 Luciani ..... G08G 1/0104 701/117
2002/0188888 A1* 12/2002 Rivoir ..... H04L 1/242 714/25
2009/0210141 A1* 8/2009 Young ..... G08G 1/0104 701/119
2009/0231126 A1* 9/2009 Huang ..... G06Q 10/06 340/539.13
2012/0146767 A1* 6/2012 Holly ..... G06K 19/0723 340/10.1

* cited by examiner

*Primary Examiner* — Nabil H Syed
*Assistant Examiner* — Cal J Eustaquio
(74) *Attorney, Agent, or Firm* — Baker Botts L.L.P.

(57) ABSTRACT

Methods and systems include determining travel information from vehicles. In one embodiment, a system monitors traffic on a roadway in real-time. The system includes a plurality of reader devices. The reader devices are capable of asynchronously capturing a unique network identifier of a device in a vehicle when the device is disposed in reader range of the reader devices. The reader device time stamps each captured unique network identifier. The time stamped unique network identifier is forwarded to a host module. The host module receives the time stamped unique network identifier. In addition, the host module determines travel information from the time stamped unique network identifier by comparing the time stamped unique network identifier for a particular vehicle to other time stamped unique network identifiers captured for the particular vehicle.

19 Claims, 5 Drawing Sheets

ANONYMOUS WIRELESS ADDRESS MATCHING FOR TRAFFIC INFORMATION

CROSS-REFERENCE TO RELATED APPLICATIONS

This application is a continuation application that claims the benefit of U.S. application Ser. No. 12/790,903 filed on May 31, 2010, a non-provisional application that claims the benefit of U.S. Application Ser. No. 61/182,341 filed on May 29, 2009, which are incorporated by reference herein in their entirety.

STATEMENT REGARDING FEDERALLY SPONSORED RESEARCH OR DEVELOPMENT

This application was made with government support with the City of Houston under Reference Number 405410 and with the University Transportation Center for Mobility (UTCM) under reference number 476090-00044.

BACKGROUND OF THE INVENTION

Field of the Invention

This invention relates to the field of traffic monitoring and more specifically to the field of real-time data collection and analysis of traffic.

Background of the Invention

The increasing population and high demand for travel has resulted in increased traffic congestion on the nation's roadways. Increased vehicle traffic congestion, which causes traveler and freight delay, increased fuel consumption and emissions, and reduced safety, has prompted a desire for the collection, analysis, and dissemination of traffic data by the agencies responsible for operating the roadway networks. One data element that is typically a critical part of any traffic data collection routine is vehicle travel times. Vehicle travel times are typically collected using traffic monitoring systems. Monitoring such collected travel times facilitates analysis of results such as traffic management functions, traveler information, and planning activities.

To collect travel times, a wide variety of conventional traffic data collection methods have been developed. Such methods include using vehicles with toll tags as probes, license plate recognition, global positioning systems (i.e., GPS), and cellular phone signal triangulation. Such conventional methods have drawbacks to their application. For instance, drawbacks to toll tags include the comparatively high costs and the proprietary nature of the monitoring equipment. Further drawbacks to toll tags include the physically invasive infrastructure used (in most cases equipment must typically be installed over the roadway) and the privacy issues related to collecting an individual's toll tag information. Drawbacks to license plate recognition include the expensive cost of the equipment and privacy issues associated with collecting an individual's license plate number. In addition, because of the expensive cost and relatively invasive nature of the systems, both methods typically provide a limited amount of data for the roadway network.

Consequently, there is a need for an improved method of travel time data collection. Additional needs include real-time traffic monitoring and data analysis.

BRIEF SUMMARY OF SOME OF THE PREFERRED EMBODIMENTS

These and other needs in the art are addressed by a system for monitoring traffic on a roadway in real-time. The system includes a plurality of reader devices. The reader devices are capable of asynchronously capturing a unique network identifier of a device in a vehicle when the device is disposed in reader range of the reader devices. The reader devices time stamp each captured unique network identifier. The time stamped unique network identifier is forwarded to a host module. In addition, the host module receives the time stamped unique network identifier. The host module determines travel information from the time stamped unique network identifier by comparing the time stamped unique network identifier for a particular vehicle to other time stamped unique network identifiers captured for the particular vehicle.

These and other needs in the art are addressed in another embodiment by a method for monitoring traffic on a roadway in real-time. The method includes asynchronously capturing unique network identifiers of devices from vehicles on the roadway. A plurality of reader devices asynchronously capture the unique network identifiers. The method further includes time stamping the captured unique network identifiers. In addition, the method includes forwarding the time stamped unique network identifiers to a host module. The method also includes determining travel information from the time stamped unique network identifiers. The host module determines the travel information from the time stamped unique network identifier by comparing the time stamped unique network identifier for a particular vehicle to other time stamped unique network identifiers captured for the particular vehicle.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
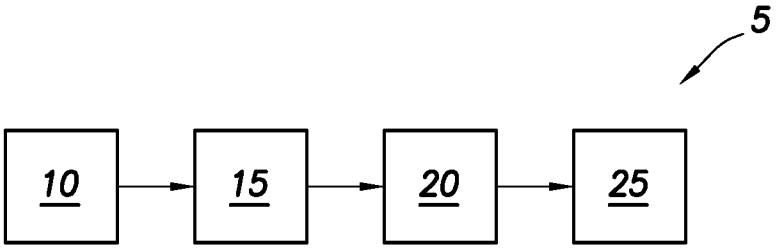
FIG. 1 illustrates a flow chart for a traffic monitoring system having reader devices and a host module.

FIG. 1 illustrates an embodiment of a traffic monitoring system 5. Traffic monitoring system 5 monitors the unique network identifiers of devices 15 to track vehicles 10. As shown in FIG. 1, traffic monitoring system 5 includes reader device 20 and host module 25. Traffic monitoring system 5 collects data from a sufficient number of vehicles 10 and processes the data to determine travel information. Traffic monitoring system 5 monitors the unique network identifiers in real-time, which allows real-time determination of the travel information. It is to be understood that real-time refers to the actual time in which a physical process occurs. Since traffic monitoring system 5 immediately forwards unique network identifiers to host module 25, host module 25 is immediately capable of determining the travel time of any unique network identifiers that are read by successive reader devices 20 along an instrument roadway.

Device 15 may be any device having a unique network identifier. In an embodiment, device 15 is a wireless device. A wireless device refers to a device that may transfer information over a distance without the use of wires. Without limitation, examples of device 15 include a mobile phone, personal computer, global positioning system (GPS) unit, or telephone headset. In an embodiment, device 15 is a mobile phone. A mobile phone refers to an electronic device that is used for mobile telecommunications over a cellular network. In some embodiments, the unique network identifier is a media access control address (MAC address). A MAC address refers to a unique identifier assigned to the device 15. Device 15 may be disposed in or on vehicle 10. In embodiments, the wireless device (e.g., device 15) includes short-range communications technology. Without limitation, a commercial example of the short-range communications technology is BLUETOOTH®, which is a registered trademark of Bluetooth SIG, Inc. In some embodiments, the short-range communications technology (e.g., BLUETOOTH®) is enabled and in discovery mode. In an embodiment, the unique network identifier is secondary to the primary function of device 15. In some embodiments, the unique network identifier is non-proprietary.

Vehicle 10 may be any type of vehicle. For instance, vehicle 10 may be a car, truck, motorcycle, or the like.

Figure 2:
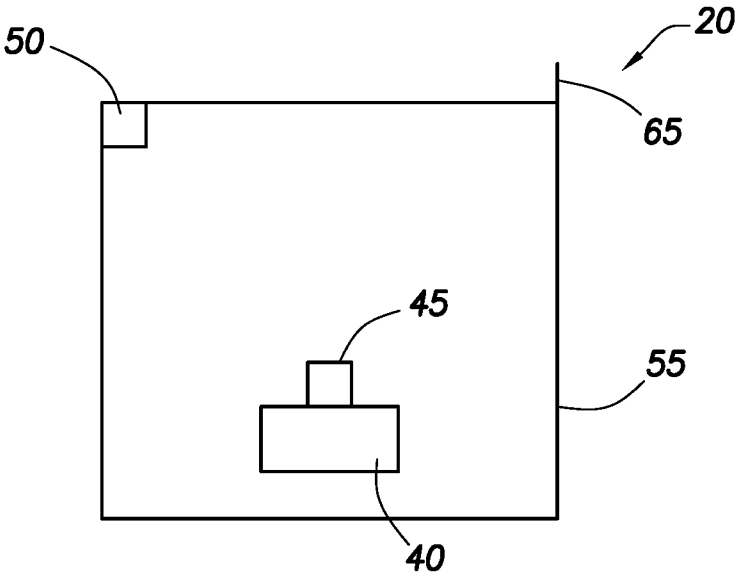
FIG. 2 illustrates an embodiment of a reader device.

Reader device 20 includes any equipment suitable for the capture and transmission of unique network identifiers. FIG. 2 illustrates an embodiment of reader device 20 having a computer 40, an adapter 45, a network communications device 50, and an antenna 65. Computer 40 may be any suitable type of computer. In an embodiment, the computer is a field hardened single board computer operating in a traffic signal cabinet at the roadside. Adapter 45 includes any type of adapter suitable for wireless data connectivity between computer 40 and device 15. Without limitation, a commercial example of the adapter 45 is a BLUETOOTH® version 2.0 Class 1 adapter. In an embodiment, the software on computer 40 captures the unique network identifiers of device 15 by interrogating the software interface of adapter 45. Network communications device 50 includes any type of communications device suitable for transmitting and/or receiving information. In an embodiment, network communications device 50 is a communications device suitable for transmitting the data captured by computer 40. Antenna 65 may be any antenna suitable for use with adapter 45. In embodiments, antenna 65 is an omni-directional antenna. In an embodiment as illustrated in FIG. 1, reader device 20 includes housing 55 in which are disposed computer 40, adapter 45, and/or network communications device 50. In embodiments, reader device 20 is disposed at a sufficient proximity to a roadway on which vehicle 10 is disposed (i.e., traveling) for reader device 20 to capture the unique network identifier. In an embodiment, reader device 20 is proximate to the roadway on which vehicle 10 is disposed. In an embodiment, two reader devices 20 are sufficiently disposed to capture unique network identifiers at consecutive points on a desired roadway. In other embodiments, traffic monitoring system 5 includes a plurality of reader devices 20 sufficiently disposed to capture unique network identifiers on a desired roadway.

In embodiments, computer 40 includes software for reading and forwarding the unique network identifiers of detected devices 15. In embodiments, the software immediately forwards the unique network identifiers to host module 25. In an embodiment, the software of reader device 20 anonymizes the captured unique network identifiers and sends anonymous unique network identifiers to host module 25. In some embodiments, reader device 20 utilizes an Ethernet-based device to automatically forward a data packet comprising a captured unique network identifier, timestamp, and location of the reader device 20 in real-time to an Internet protocol (IP) address and port where the host module 25 is disposed. Without limitation, a commercial example includes computer 40 running the Python programming language interpreter on a LiNUX® kernel. LINUX® is a registered trademark of Linus Torvalds.

By default, the software utilized for interrogating the devices 15 (containing a unique network identifier) through the adapter 45, takes a fixed amount of time to complete, for instance around ten seconds. In addition, subsequent to each interrogation, there is no method to distinguish the exact timestamp of when a device 15 was detected in the ten second window. Therefore, if utilized in its default form, the interrogation methods can have a timestamp error of up to ten seconds, which can negatively impact the accuracy of determining travel times. In embodiments, the software of reader device 20 asynchronously interrogates and timestamps devices 15 so that unique network identifiers are immediately time stamped upon reception, so error is minimized. This method results in a more accurate determination of travel time information.

Host module 25 includes host software. The host software accepts the anonymous unique network identifiers forwarded by reader device 20. In embodiments, host module 25 accepts anonymous unique network identifiers from a plurality of reader devices 20. In some embodiments, the host module 25 (i.e., host module software) receives a transmitted data pack from all reader devices 20 located on a pre-configured roadway network and specified in the host module 25 software configuration. In an embodiment, the host software determines the travel information (i.e., travel time) from the accepted anonymous unique network identifiers. In embodiments, the determination of the travel information (i.e., travel time) includes matching the readings of a particular anonymous unique network identifier to successive reader devices 20 on a roadway. For instance, an application on the host module 25 (i.e., server) compares incoming MAC addresses with corresponding MAC addresses at paired locations to determine matches. In an embodiment, determining the travel information (i.e., average travel time) for a roadway also includes comparing the travel information (i.e., travel times) for all of the vehicles 15 on the roadway that were matched between paired reader devices 20 on a pre-configured roadway link. The travel information (i.e., travel time averages) includes any travel information (i.e., travel time) that may be determined from the anonymous unique network identifiers. In embodiments, the travel information includes average travel times on a roadway, average speeds on a roadway, median travel times on a roadway, median speeds on a roadway, the number of travel time samples used for calculating the travel time and speed averages, vehicle location on a roadway, vehicle location at times on a roadway, or any combinations thereof. In an embodiment, the travel information includes average travel times on a roadway, average speeds on a roadway, or any combinations thereof. In embodiments, host module 25 is remote from the roadway. Without limitation, a commercial example of host module 25 includes host module 25 running the MICROSOFT® .NET framework in a WINDOWS® environment. MICROSOFT® and WINDOWS® are registered trademarks of Microsoft Corporation.

Figure 3:
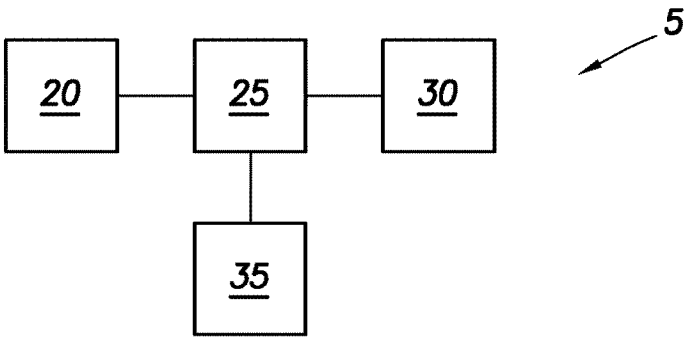
FIG. 3 illustrates an embodiment of the traffic monitoring system of FIG. 1 having a web display and data analysis package.

FIG. 3 illustrates an embodiment of traffic monitoring system 5 having display 30 and data analysis package 35. Display 30 is any type of visual display by which the travel information may be viewed. In an embodiment, display 30 is a web-based display. For instance, the travel information may be accessed by display 30 via the Internet. In such an embodiment, a user may view the travel information in real-time on any type of electronic display device such as a computer screen, mobile phone screen, personal digital assistant screen, and the like. For instance, a user may view real-time travel information about desired roadways in the form of a map, chart, or the like on a computer screen. In embodiments, display 30 shows the travel information such as time and speed averages as determined by host module 25. In an embodiment, display 30 shows the travel information from the last fifteen minutes and updates it every thirty seconds. In some embodiments, travel information (i.e., real-time travel information) at a desired location on a roadway may be accessed by viewing color-coded lines on a map or by viewing information boxes associated with a roadway link instrumented with a pair of reader devices 20. In other embodiments, a history of travel information may be accessed on display 35. Data analysis package 35 includes chart-based summaries of desired and historical travel information. In embodiments, data analysis package 35 includes real-time summaries of travel information along with historical summaries. Data analysis package 35 includes tools to view travel information such as individual travel time and speed samples calculated by host module 25, average speed and travel times per fifteen minute period as calculated by host module 25, total number of unique network identifiers from each device reader 20, and total number of travel time and speed samples per 15 minute period as determined by host module 25. In some embodiments, display 30 and/or data analysis package 35 include a graphical user interface that includes a map and/or web-based charts.

In an embodiment, traffic monitoring system 5 has a filtering method by which software of reader devices 20 eliminate duplicate unique network identifier readings. In embodiments, the software of reader devices 20 affixes identifiers on duplicate unique network identifier readings. In embodiments, reader device 20 continues reading (i.e., capturing) the unique network identifier for a particular vehicle 10 as it moves through the reading range of the reader device 20, which provides the reader device 20 with duplicate readings of the particular vehicle 10. Without limitation, eliminating duplicate unique network identifier readings simplifies data sent to host module 25 (i.e., the host software improving the probability of the host module 25 determining accurate travel information). In an embodiment, the filtering method only keeps the first reading within the reading range of reader device 20 of a unique network identifier for a particular device 15 in vehicle 10 and eliminates the other readings (i.e., duplicate readings) of the unique network identifier for the particular vehicle 10.

Figure 4:
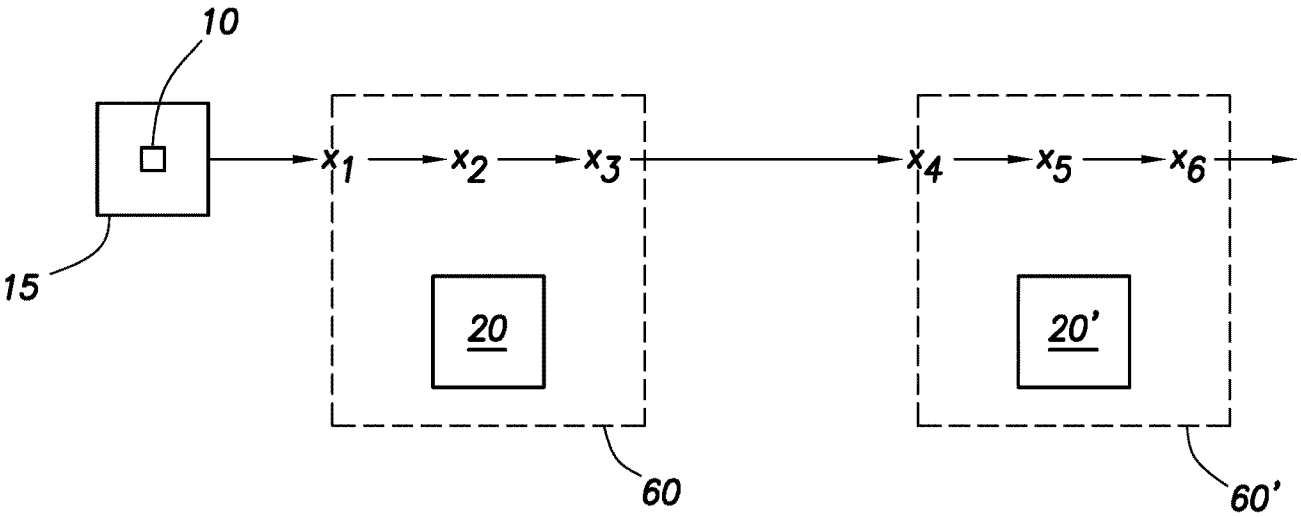
FIG. 4 illustrates an embodiment of a filtering method for multiple positions of a vehicle.

For illustration purposes of an embodiment of operation of the filtering method, FIG. 4 is provided to show an example of different positions $x_1$, $x_2$, $x_3$, $x_4$, $x_5$, and $x_6$ of a vehicle 10 along a roadway. Two reader devices 20, 20' are shown in FIG. 4 for illustrative purposes only. It is to be understood that the filtering method may be used when traffic monitoring system 5 includes a plurality of reader devices 20 on a roadway. It is to be further understood that the arrows illustrate movement of vehicle 10 between positions $x_1$, $x_2$, $x_3$, $x_4$, $x_5$, and $x_6$. As the vehicle 10 moves along the roadway and enters the reading range 60 of reader device 20, reader device 20 captures the unique network identifier of a device 15 (i.e., mobile phone with enabled BLUETOOTH®) in the vehicle 10 at position $x_1$. As vehicle 10 moves along the roadway though reading range 60, reader device 20 continues to read the unique network identifier at different positions along the roadway (i.e., positions $x_2$, $x_3$) until vehicle 10 moves out of reading range 60. The software of reader device 20 assigns timestamps and the reader device 20 location string for the readings at each position $x_1$, $x_2$, $x_3$. The time stamping provides a time at which the unique network identifier was captured, and the location string identifies the physical location of reader device 20. In embodiments, the software also eliminates the duplicate readings (i.e., $x_2$, $x_3$). As vehicle 10 moves further along the roadway and enters the reading range 60' of reader device 20', reader device 20' captures the unique network identifier at position $x_4$. As vehicle 10 moves along the roadway though reading range 60', reader device 20' continues to read the unique network identifier at the different positions $x_5$, $x_6$ until vehicle 10 moves out of reading range 60'. The software of reader device 20' assigns timestamps and location string for the readings at each position $x_4$, $x_5$, $x_6$. In embodiments, the software also eliminates the duplicate readings (i.e., $x_5$, $x_6$). The time stamped readings captured at positions $x_1$ and $x_4$ are sent to host module 25. In an embodiment, host module 25 may determine the travel time and speed between the positions of readers 20 and 20' on the roadway from the time stamped and location string of anonymous unique network identifier readings at positions $x_1$ and $x_4$.

As illustrated in FIGS. 1-4, an embodiment of operation of traffic monitoring system 5 includes a plurality of reader devices 20 disposed at different locations on a roadway. The physical distance between reader devices 20 is arbitrary but in some embodiments must be known to determine speed from travel time. When moving vehicles 10 on the roadway are within reader range 60 of a reader device 20, the reader device 20 reads the unique network identifiers of the devices 15 in the vehicles 10. The software of reader device 20 provides a real-time capture of the unique network identifiers and attaches the location string of reader device 20. In embodiments, the software of reader device 20 timestamps the captured unique network identifiers. In other embodiments, the software of reader device 20 eliminates duplicate readings of each device 15 for a particular reader device 20. In an embodiment, the software of reader device 20 anonymizes the unique network identifiers to provide an anonymous unique network identifier to host module 25. The reader device 20 sends the time stamped anonymous unique network identifiers to host module 25 in real-time. As the vehicles move from the reader range 60 of a reader device 20 to the reader range 60 of another reader device 20 or more than one reader device 20, the host module 25 receives each of the time stamped anonymous unique network identifiers from all of the reader devices 20 in real-time. Host module 25 may then determine the desired travel information in real-time. The travel information may then be published via display 30, data analysis package 35, and/or any other desired method.

In embodiments, traffic monitoring system 5 monitors vehicle 15 traffic on more than one roadway. In such embodiments, when more than one roadway that are being monitored by traffic monitoring system 5 have intersections with each other, embodiments of traffic monitoring system 5 may have one reader device 5 within reader range 60 of the intersection to capture unique network identifiers for both roadways.

In some embodiments, traffic monitoring system 5 eliminates determined travel information. In such embodiments, host module 25 includes algorithms for filtering out certain travel information. Host module 25 has algorithms that eliminate travel information outside of a desired range. Without limitation, the travel information is eliminated outside of a desired range to exclude data that does not accurately represent the true travel information (i.e., travel time) on a roadway link. For instance, if a device 15 from a vehicle 10 is read at a reader device 20 and then stops at a gas station or otherwise pulls off the roadway for a time and then resumes moving on the roadway and is read at a successive reader device 20, the calculated travel time sample (e.g., from the anonymous unique network identifiers) is eliminated. In an embodiment, the algorithm determines the true mean, median, or other travel information for defined roadway links and eliminates captured data outside of a desired range within a percentile of the estimated mean, median, or other travel information. In embodiments, the host module 25 assigns different algorithms (i.e., filtering algorithms) depending on the type of roadway. For instance, the host module 25 may assign a different algorithm to an arterial street than to a highway. Characteristics determining which algorithm is used include distance between successive reader devices 20, roadway traffic volumes, and roadway geometrics of the defined link (i.e. number of traffic signals, posted speed limit, etc.).

To further illustrate various illustrative embodiments of the present invention, the following examples are provided.

EXAMPLES

Reader devices were deployed and tested on roadways. The reader devices included a notebook style computer, a USB BLUETOOTH® adapter, and a cellular modem used for transmitting the BLUETOOTH® device unique network identifiers to a central server. Determining travel times involved matching vehicle identifiers along consecutive reader locations on an instrumented roadway. Devices observed by consecutive readers were used to sample the travel time of vehicles between the reader locations. Algorithms were used to aggregate the travel time data for specific intervals. Individual travel time samples were averaged to determine the speed and travel time for a roadway segment during a particular period.

Figure 5:
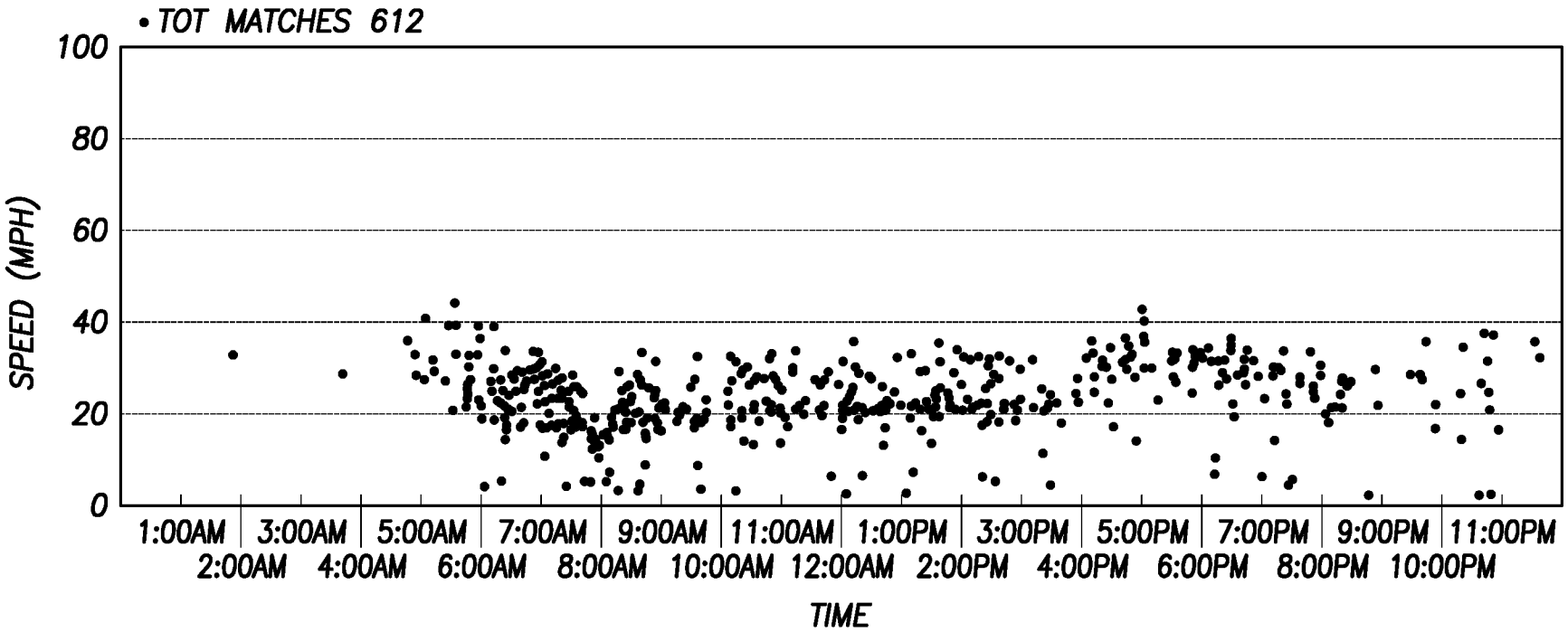
FIG. 5 illustrates an anonymous wireless address matching speed sample distribution for AM peak direction.
Figure 6:
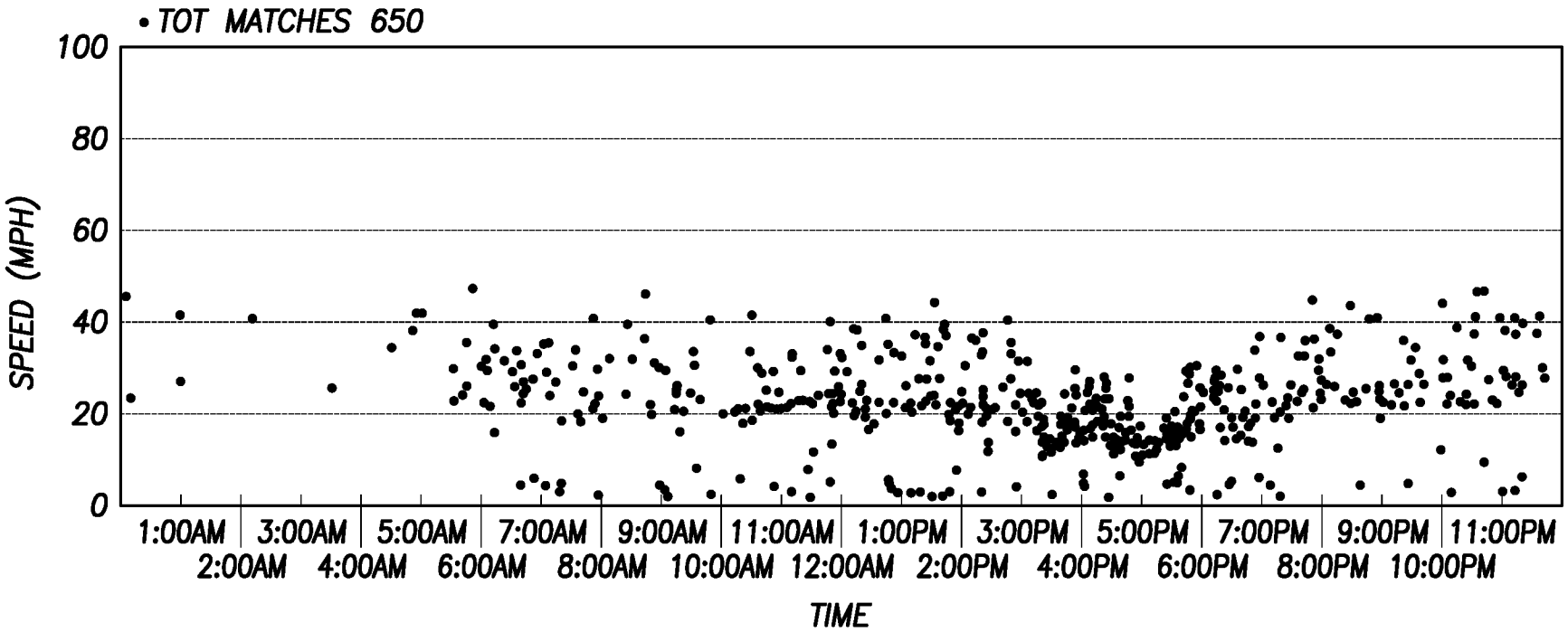
FIG. 6 illustrates an anonymous wireless address distribution for PM peak direction.

A web-based software tool was developed to chart the individual travel time and speed samples generated by the algorithm. Charts representing one day's (24 hours) samples are shown in FIGS. 5 and 6. Each data point represents a matched travel time calculated by the system. The data in FIG. 5 shows the drop in speed during the AM peak period for the peak direction (northbound). The data in FIG. 6 shows the drop in speeds during the peak PM direction (southbound). As shown, the system was able to collect very few matches between 11 PM and 5 AM due to a lack of vehicles equipped with BLUETOOTH® devices. In addition, the chart also show "outlier" data points, which represent vehicles with BLUETOOTH® devices that presumably stopped after being read by a reader device (i.e., origin reader) and then continued to another reader (i.e., destination reader) after a period of time. This caused a slow speed to be reported, but outliers were not filtered for this example.

Figure 7:
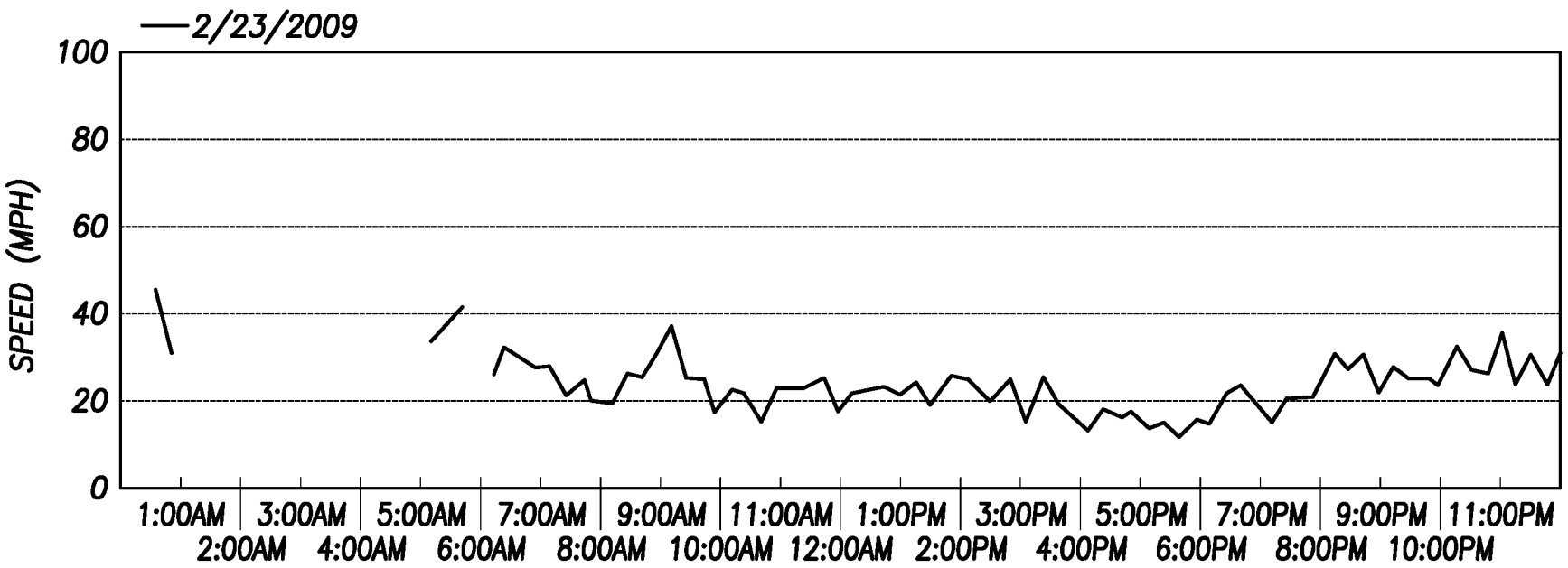
FIG. 7 illustrates a 15 minute speed summary.

The software tool also allowed users to view 15 minute summaries of individual samples collected by the system. A chart showing 24 hours of 15 minute speed summaries of Main southbound from Pressler to Braesmain is shown in FIG. 7. The line represents the average speed calculated by the system in 15 minute intervals for an entire day. A rudimentary filter was applied to remove the outliers shown in FIGS. 5 and 6 from the averages in this chart. This chart also showed the lack of data in the early morning hours.

A map was developed that combined the travel time and speed data. Software was developed to read and process the outputs of the travel time algorithm and display them in real-time on a map. Color-coded line segments were drawn on the instrumented roadway to represent the most recent average speed ranges measured by the system. Travel times were viewed by clicking on top of each roadway segment. Color segments represented speeds collected.

Results of the Example includes that the travel time and speed data from the system could be displayed in real-time on a traffic map.

Although the present invention and its advantages have been described in detail, it should be understood that various changes, substitutions and alterations may be made herein without departing from the spirit and scope of the invention as defined by the appended claims.

What is claimed is:

1. A system for analyzing traffic patterns on a roadway in real-time, the system comprising:

a plurality of reader devices, each particular reader device configured to:

capture a unique network identifier of a device in a vehicle when the device is disposed in reader range of the particular reader device;

immediately time stamp each captured unique network identifier upon reception;

anonymize the time stamped unique network identifiers to provide time stamped anonymous unique network identifiers;

identify duplicate readings of a captured unique network identifier in the reader range of the particular reading device;

discard one or more of the identified duplicate readings of the captured unique network identifier;

immediately forward a time stamped anonymous unique network identifier to a host module; and provide a data packet to the host module, wherein the data packet comprises the time stamped anonymous unique network identifier and location of the particular reader device; and wherein the host module is configured to:

receives the time stamped anonymous unique network identifier; and determine travel information from the time stamped anonymous unique network identifier by comparing the time stamped anonymous unique network identifier for a particular vehicle at a first reader device to time stamped anonymous unique network identifiers captured from a second reader device for the particular vehicle.

2. The system of claim 1, wherein the plurality of reader devices each comprise a computer, wherein the computer includes or uses software.

3. The system of claim 1, wherein the host module comprises host module software.

4. The system of claim 1, wherein the host module determines the travel information from a plurality of vehicles on the roadway.

5. The system of claim 1, wherein the unique network identifier comprises a media access control address.

6. The system of claim 1, wherein the device comprises a wireless device, and wherein the device comprises short-range communications technology.

7. The system of claim 1, wherein the host module identifies travel information outside of a range.

8. The system of claim 1, wherein the reader device immediately time stamps each unique network identifier upon capture.

9. The system of claim 1, wherein the unique network identifier is a media access control address.

10. A method for analyzing traffic patterns on a roadway in real-time, comprising:

capturing unique network identifiers of devices from vehicles on the roadway, wherein a plurality of reader devices capture the unique network identifiers of vehicles at two or more locations on the roadway;

immediately time stamping the captured unique network identifiers upon reception to provide time stamped unique network identifiers;

anonymizing the time stamped unique network identifiers to provide anonymous time stamped unique network identifiers;

identifying duplicate readings of a captured unique network identifier in a reader range of a reading device;

discarding one or more of the Identified duplicate readings of the captured unique network identifier;

immediately forwarding the anonymous time stamped unique network identifiers to a host module, wherein forwarding the anonymous time stamped unique network identifiers to the host module comprises providing a data packet to the host module, the data packet comprising the anonymous time stamped unique network identifier and location of the reader device; and determining travel information from the anonymous time stamped unique network identifiers, wherein the host module determines the travel information from the anonymous time stamped unique network identifier by comparing the anonymous time stamped unique network identifier for a particular vehicle at a first reader device to anonymous time stamped unique network identifiers captured from a second reader device for the particular vehicle.

11. The method of claim 10, wherein the plurality of reader devices each comprise a computer, wherein the computer includes or uses software.

12. The method of claim 10, further comprising determining the travel information from a plurality of vehicles on the roadway.

13. The method of claim 10, wherein the device comprises a wireless device, and wherein the device comprises short-range communications technology.

14. The method of claim 10, further comprising identifying travel information outside of a range.

15. The method of claim 10, wherein time stamping comprises immediately time stamping each unique network identifier upon capture.

16. A system for analyzing traffic patterns on a roadway in real-time, the system comprising;

a plurality of reader devices, each particular reader device configured to:

capture a unique network identifier of a device in a vehicle when the device is disposed in reader range of the particular reader device;

immediately time stamp each captured unique network identifier upon reception to provide a time stamped unique network identifier;

anonymize the time stamped unique network identifiers to provide time stamped anonymous unique network identifiers;

discard one or more duplicate readings of the captured unique network identifier of the device in the vehicle;

immediately forward a time stamped anonymous unique network identifier to a host module;

wherein the host module is configured to:

receive the time stamped anonymous unique network identifier; and determine travel information from the time stamped anonymous unique network identifier by comparing the time stamped anonymous unique network identifier for a particular vehicle at a first reader device to time stamped anonymous unique network identifiers captured from a second reader device for the particular vehicle.

17. The system of claim 1 wherein the reader devices include software that asynchronously interrogates and time-stamps the reader devices so that unique network identifiers are immediately time stamped upon reception.

18. The method of claim 10 wherein the reader devices include software that asynchronously interrogates and time-stamps the reader devices so that unique network identifiers are immediately timestamped upon reception.

19. The system of claim 1, wherein discarding one or more of the identified duplicate readings of the captured unique network identifier comprises discarding all duplicate readings of the captured unique network identifier except for one of the identified duplicate readings.

* * * * *